US007762346B2

(12) United States Patent
Jonsson

(10) Patent No.: US 7,762,346 B2
(45) Date of Patent: Jul. 27, 2010

(54) METHOD AND SYSTEM FOR COLLARING

(75) Inventor: Per Jonsson, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 559 days.

(21) Appl. No.: 11/578,868

(22) PCT Filed: May 31, 2005

(86) PCT No.: PCT/SE2005/000819

§ 371 (c)(1),
(2), (4) Date: Oct. 18, 2006

(87) PCT Pub. No.: WO2005/121506

PCT Pub. Date: Dec. 22, 2005

(65) Prior Publication Data

US 2007/0209812 A1 Sep. 13, 2007

(30) Foreign Application Priority Data

Jun. 9, 2004 (SE) ..... 0401472

(51) Int. Cl.
*B23Q 5/00* (2006.01)

(52) U.S. Cl. ..... 173/4; 173/1

(58) Field of Classification Search ..... 175/40, 175/414; 173/1, 4, 11
See application file for complete search history.

(56) References Cited

U.S. PATENT DOCUMENTS

| | | | | |
|---|---|---|---|---|
| 3,670,826 | A | 6/1972 | Hanson et al. | |
| 4,699,223 | A * | 10/1987 | Noren | 175/40 |
| 6,209,661 | B1 | 4/2001 | Muona | |
| 6,505,689 | B1 | 1/2003 | Poysti et al. | |
| 7,322,425 | B2 * | 1/2008 | Keskiniva et al. | 173/1 |

FOREIGN PATENT DOCUMENTS

| | | |
|---|---|---|
| EP | 0564504 | 8/1996 |
| WO | 9528549 | 10/1995 |
| WO | WO 03050388 A1 * | 6/2003 |

* cited by examiner

*Primary Examiner*—Daniel P Stephenson
(74) *Attorney, Agent, or Firm*—Mark P. Stone

(57) ABSTRACT

The present invention relates to a method for controlling drilling parameters during an initial phase of rock drilling with a drilling machine. In accordance with the invention the percussion pressure and feed pressure of the drilling machine are controlled as continuously increasing functions during the initial phase. The present invention also relates to such a system.

20 Claims, 2 Drawing Sheets

Prior art

METHOD AND SYSTEM FOR COLLARING

TECHNICAL FIELD

The present invention relates to a method and system for controlling drilling parameters during an initial phase of drilling into a rock.

BACKGROUND OF THE INVENTION

When drilling, it is very important that the start-up is performed in a correct manner. Thus, at the start-up of drilling into rocks with a percussion rock drilling machine, it has to be ensured that the first part of the hole is accurately accomplished in order for the hole to be positioned at an intended place and have a correct direction.

In order to obtain a good start of the drilling, it is desired to try to control the drilling steel as good as possible near the drill bit at the beginning of the drilling (drill steel support), as well as to drill the first part of the hole using a reduced feed force and a reduced drilling power in order to prevent the drilling steel from sliding against the surface of the rock. In other words, the critical part of the drilling, i.e. the start-up or so called collaring, should be smooth and careful until there has been formed a deep enough hole having a correct direction, whereafter full feed force and drilling power may be utilized. What constitutes a deep enough depth depends to a large part on the quality of the rock. For example, soft rocks having many cracks may require a deeper hole to ensure a correct direction, before full feed force is used.

When the use of hydraulic rock drilling machines at first started, generally, these were powered by uncomplicated direct controlled hydraulic systems. The collaring was realized by starting the drilling at a reduced hydraulic pressure supply to the percussion circuit and feed drive of the drilling machine. After a certain time, or when a certain drilled hole depth is reached, the pressures were increased to such values that resulted in a desired balance between drilling speed and working life of the drilling steel (full drilling). This pressure increase was performed by adjusting sequence valves, and the pressure increase process depended on the valves and ducts in the hydraulic system.

When more modern electrically and computer controlled hydraulic systems later have come in use, the process of an initial drilling step has been maintained, in which a reduced drilling machine power and feed force is used, and a final drilling step where full power is utilised. A suitable transition occurs there between.

An example of such a previously known method for controlling drilling parameters is shown in the European patent EP 0 564 504. This publication discloses a method for controlling a rock drilling process, and in accordance with the method described therein the percussion force and feed force of a drilling machine are adjusted, so that the rotational power of the drill does not exceed a pre-set limit value.

This is done by controlling the drilling in at least three different stages, of which the first stage constitutes the start-up drilling, the second a transition stage to the third, which in turn is the normal operation. According to the method, suitable values for each drilling stage are to be set, so that the percussion force and feed force are optimal for each stage.

There are several drawbacks with the method described in EP 0 564 504. An obvious drawback is that it is not always known in advance what is optimal for a certain stage, and it is not evident from said document how the predetermined feed force and percussion force values for the respective stage are to be determined in order to be optimal. Another drawback is that the process with three or more stages in the control program is unnecessarily complicated, since, among other things, it has to be determined, on the one hand, how long the first reduced stage is to go on, and, on the other hand, what the transition stage should look like.

The transition step should be smooth, but not unnecessary extended in order to avoid that time is lost because a great part of the hole is drilled at a lower power than the available full power. Consequently, the parameters that have to be set constitutes a considerable drawback of the method shown in EP 0 564 504. There are a number of parameters to adjust for each of the three or more stages, for example, different periods of time, percussion force, feed force, drilling time, drilling depth, speeds etc. Moreover, discontinuities in the direction of drilling parameter increase may give incorrect information to those parts of the automatic control system that supervise these parameters in order to detect a drill possibly getting stuck.

It would thus be desirable to provide a method and an apparatus that simplifies and improves the initial phase of drilling in rock.

OBJECTS AND MOST IMPORTANT FEATURES OF THE INVENTION

It is an object of the present invention to provide a method and a system that solves the above problems. More specifically, it is an object of the present invention to provide an improved method and a system for controlling drilling parameters during collaring, in which the time consumption can be minimised, as well as the number of parameters that have to be set. Another object of the present invention is to provide a method and a system for controlling drilling parameters during collaring, which ensures that the collaring hole obtains the intended direction and position.

These and other objects are achieved according to the present invention by a method for controlling drilling parameters in an initial phase, as claimed in claim 1, and according to a system as claimed in claim 6.

According to the present invention, the above mentioned objects are accomplished by a method for controlling drilling parameters during an initial phase of drilling in rock using a drilling machine, whereby the percussion pressure and feed pressure of the drilling machine are controlled as continuously increasing functions during the initial phase.

Thereby, the number of parameters can be minimised to include start values for the percussion and feed pressure, and time duration of the initial phase. Further, a successful drilling is ensured by adjusting the collaring depth by means of the duration of the initial phase.

According to the present invention, the initial phase thus includes a single stage control starting from predetermined start values to full force values. This results in a time efficient initial drilling, wherein the time to set different parameters in a plurality of different stages has been eliminated.

According to one embodiment of the present invention, the control is represented by functions, which are continuous in time and having a gradually increasing derivative. Thereby, a continuously increasing pressure is obtained, whereby the initial phase results in a collaring hole with a correct direction, whereby the risk of drilling steel slip is minimised.

According to another embodiment of the present invention, said continuous functions are represented by exponential functions. In this way, a well known mathematic function may be used which can easily be programmed and stored.

According to another embodiment of the present invention, the feed pressure is supervised during the collaring stage, so that the percussion pressure is limited if the damping pressure with certainty does not exceed the idling pressure of the damper. Thereby, it is ensured that the percussion pressure of the drilling machine is limited when the drilling steel shank is not in percussion position. This supervision may, for example, be performed by means of a RPCF function (Rotation Pressure Controlled Feed), and the percussion pressure values may, in a preferred embodiment, be limited to the percussion pressure start values. Alternatively, the percussion pressure may be lowered when the feed pressure goes below a predetermined level.

The present invention is also related to such a system, by means of which advantages similar to the above described is achieved.

Further advantages are obtained in different aspects of the invention, and will be apparent from the following detailed description.

DETAILED DESCRIPTION OF PREFERRED EMBODIMENTS

Figure 1:
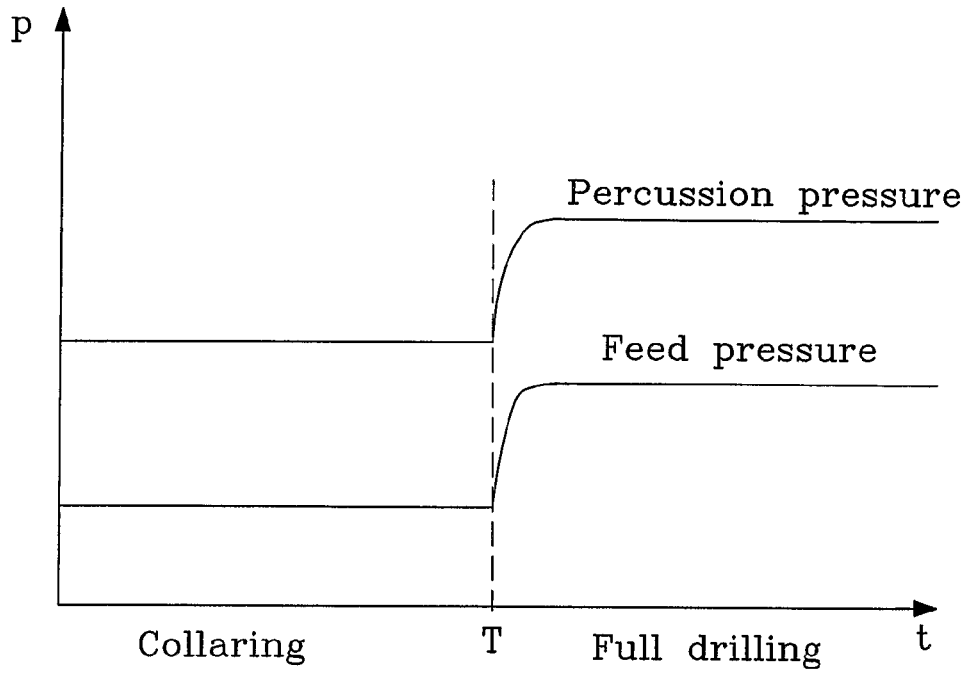
FIG. 1 shows a timing diagram of a prior art method for collaring.

The prior art method for performing collaring described above is shown in FIG. 1. During collaring, this method starts with a reduced feed force and percussion force. No parameter control is thus performed, the pressure increase is due to valves and ducts used in the hydraulic system.

Figure 2:
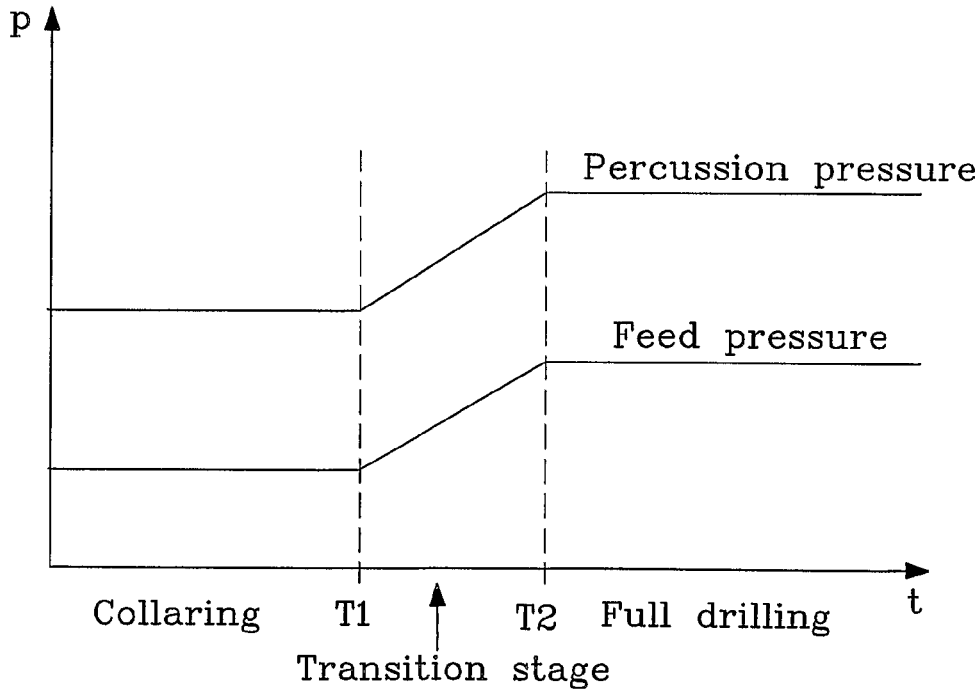
Prior Art Fig. 2
FIG. 2 shows a timing diagram of another prior art method for collaring.

In FIG. 2, the second of the above disclosed, previously known methods for controlling electric and computer controlled hydraulic systems is shown, in which a suitable transition occurs between the initial stage, and its corresponding values, and the final stage, in which the drilling machine is run at full capacity.

This method comprises a number of parameters that has to be set. Initial values have to be determined, and, also, for how long this stage with reduced power is to go on. Further, the aspects of the transition stage illustrated in FIG. 2, between the points T1 and T2, have to be determined. In other words, it has to be determined what the transition step should look like in order for it to be smooth enough. At the same time it is undesired to drill with the reduced power too long, since time then is lost.

With the above described solution, in some situations, there is a risk of hysteresis in the valves of the system, i.e., self-oscillation in the system. This may occur, for example, when drilling in soft and/or fissured rock, when the drill steel shank suddenly is not in percussion position anymore, and it is necessary to go down to the collaring level values of the percussion pressure. Then, it has to be started over from the beginning with a new collaring stage followed by a transition stage, before the system again is run at full capacity. This can be repeated several times, thus resulting in a very time consuming mode of operation.

Figure 3:
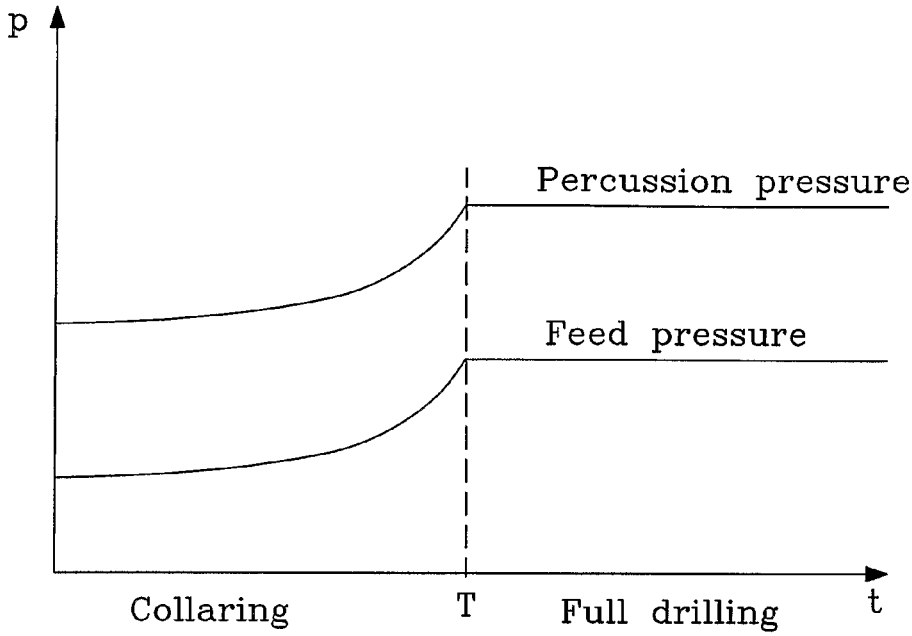
FIG. 3 shows a timing diagram of a method for collaring in accordance with the invention.

According to the present invention, all the above drawbacks are avoided. With reference to FIG. 3, a method for collaring according to the present invention will now be described.

In collaring according to the present invention, start values for the percussion pressure of the drilling machine (and thereby the percussion power of the drilling machine), and the feed pressure are chosen. These values are chosen such that the collaring is smooth enough to ensure that the hole obtains correct direction and position, while at the same time the pressure cannot be so low that it may cause problems in the drilling machine. For example, start values are advantageously chosen to be slightly higher than the accumulator pressure in order to avoid problems with included membranes. The start values should, off course, neither be too low to accomplish a collaring hole. The start values may, for example, in an ordinary drilling machine, be about 130 bar.

The initial phase, or collaring phase, is then controlled by continuously increasing functions. In the preferred embodiment, the continuously increasing functions have a gradually increasing derivative, as is shown in FIG. 3, which results in the preferred, smooth transition. One example of a function, which advantageously may be used, is the mathematically well known exponential function, but any substantially continuous function in accordance with the mentioned requirements may be used.

The use of a continuous function of time with a gradually increasing derivative results in a system with only two control stages, of which the parameters of the first stage, the collaring, includes the start values of the percussion pressure, the feed pressure and the length of the initial stage. Thereby, the number of parameters needed to be set is minimized. During the collaring stage, the percussion pressure and feed pressure are controlled independently, but with the same duration, i.e. throughout the collaring stage.

The feed pressure should, however, be supervised by means of the system RPCF function (Rotation Pressure Controlled Feed) during the collaring stage. The RPCF function controls the feed pressure such that the rotation pressure and/or torque is substantially constant in order to ensure that the drill string component joints are suitably tightened. This function is of particular importance during full drilling, when the power is higher.

In order to limit the percussion pressure of the drilling machine when the drill steel shank is out of position for percussion, the damping pressure of the drilling machine should be supervised so that the percussion pressure is limited to, for example, the start values if the damping pressure with certainty does not exceed the no-load pressure of the damper. As is well known to a person skilled in the art, the damper is used to damp the reflexions which arise when the drill steel hits the rock. As also is well known to a person skilled in the art, the damping pressure may be used to ensure that the drill steel is in contact with the rock at time of percussion. The initial stage may, in other words, be combined with the supervision of the damping pressure so that the percussion pressure does not run away from the feed pressure.

However, it is not always necessary to go down to the start values, even if this usually is the case since these have been chosen with regard to, among other things, the accumulator pressure. By utilising the present invention, using the control by means of continuous functions, the risk for self-oscillation is avoided in the system. Accordingly, it is not always necessary to go down to the lowest level in the collaring, i.e. the start values, if soft rock is encountered, but it is possible to go down to a level where the percussion pressure is limited with regard to the no-load pressure of the damper. Alternatively, the percussion pressure may be lowered when the feed pressure is or goes below a predetermined level.

An operator may chose between the setting of a desired hole depth of the collaring, or for how long the initial phase should go on.

Finally, the stop values may also be determined, which advantageously correspond to the full power of the drilling machine. It may, however, in some situations, be necessary to run the machine at a reduced power, whereby desired values may be set.

Figure 4:
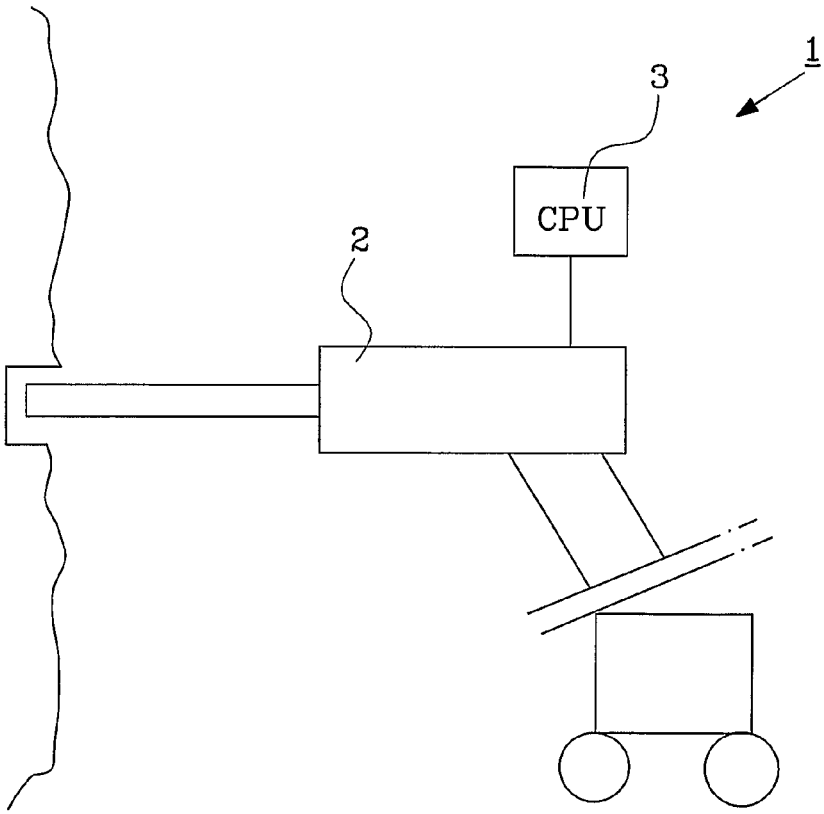
FIG. 4 schematically shows a system in which th vention may be utilised.

FIG. 4 schematically shows a system 1, in which the present invention may be utilised. The system 1 includes, in its simplest embodiment, a drilling machine 2 with a control system 3, by means of which an operator may control the system 1. The control system may be integrated with the drilling machine 2, or be separately connected.

In summary, by means of the present invention, a continuous, smooth collaring is achieved, in which the parameters that has to be set by an operator can be minimised, and in which several different stages with accompanying parameter settings are avoided altogether.

The invention claimed is:

1. Method for controlling drilling parameters during a collaring phase of drilling in rock with a drilling machine, characterised in that the percussion and feed pressure of the drilling machine are controlled as continuously increasing functions during the entire time of the collaring phase.

2. Method as claimed in claim 1, wherein said control is represented by continuous functions of time with a gradually increasing derivative.

3. Method as claimed in claim 2, wherein said continuous functions consist of exponential functions.

4. Method as claimed in claim 3, wherein the feed pressure is controlled on the basis of the rotation pressure.

5. Method as claimed in claim 2, wherein the feed pressure is controlled on the basis of the rotation pressure.

6. Method as claimed in claim 5, wherein the percussion pressure is lowered when the feed pressure is or goes below a predetermined level.

7. Method as claimed in claim 1, wherein said continuous functions consist of exponential functions.

8. Method as claimed in claim 7, wherein the feed pressure is controlled on the basis of the rotation pressure.

9. Method as claimed in claim 8, wherein the percussion pressure is lowered when the feed pressure is or goes below a predetermined level.

10. Method as claimed claim 1, wherein the feed pressure is controlled on the basis of the rotation pressure.

11. Method as claimed in claim 10, wherein the percussion pressure is lowered when the feed pressure is or goes below a predetermined level.

12. System for controlling drilling parameters during a collaring phase of drilling in rock with a drilling machine, characterised in that the system controls the percussion pressure and feed pressure of the drilling machine as continuously increasing functions during the entire time of the collaring phase.

13. System as claimed in claim 12, wherein said control is represented by continuous functions of time with gradually increasing derivative.

14. System according to claim 13, wherein said continuous functions consist of exponential functions.

15. System according to claim 14, wherein said system controls the feed pressure on the basis of the rotation pressure.

16. System according to claim 13, wherein said system controls the feed pressure on the basis of the rotation pressure.

17. System according to claim 12, wherein said continuous functions consist of exponential functions.

18. System according to claim 17, wherein said system controls the feed pressure on the basis of the rotation pressure.

19. System according to claim 12, wherein said system controls the feed pressure on the basis of the rotation pressure.

20. System according to claim 19, wherein the system lowers the percussion pressure when the feed pressure is or goes below a predetermined level.

* * * * *